US006379405B1

(12) United States Patent
Reiger et al.

(10) Patent No.: US 6,379,405 B1
(45) Date of Patent: Apr. 30, 2002

(54) FIRE STARTER AND METHOD OF MAKING SAME

(75) Inventors: Craig M. Reiger, West Bend; Robert E. Litak, Cedarburg, both of WI (US)

(73) Assignee: Meteor Lite Corporation, Milwaukee, WI (US)

( * ) Notice: Subject to any disclaimer, the term of this patent is extended or adjusted under 35 U.S.C. 154(b) by 0 days.

(21) Appl. No.: 08/324,382

(22) Filed: Oct. 17, 1994

Related U.S. Application Data

(63) Continuation of application No. 08/023,587, filed on Feb. 26, 1993, now abandoned.

(51) Int. Cl.[7] ..... C10L 11/00; C10L 11/04

(52) U.S. Cl. ..... 44/522; 44/532; 44/533; 44/544; 44/590

(58) Field of Search ..... 44/522, 530, 533, 44/532, 275, 606, 590, 543, 544

(56) References Cited

U.S. PATENT DOCUMENTS

| | | | | | |
|---|---|---|---|---|---|
| 2,933,378 | A | * | 4/1960 | Mustin et al. | |
| 3,297,419 | A | | 1/1967 | Eyre, Jr. | |
| 3,367,758 | A | * | 2/1968 | Ambrose et al. | 44/275 |
| 3,377,147 | A | * | 4/1968 | Remines | 44/522 |
| D223,722 | S | * | 5/1972 | Stehouwer | 44/522 |
| 3,883,317 | A | * | 5/1975 | Neme | |
| 4,243,393 | A | * | 1/1981 | Christian | 44/522 |
| 4,781,128 | A | * | 11/1988 | Salner | 44/530 |
| 4,981,496 | A | * | 1/1991 | Hausslein | 44/531 |
| 4,984,384 | A | * | 1/1991 | Kaufmann | 47/9 |

FOREIGN PATENT DOCUMENTS

| | | | | |
|---|---|---|---|---|
| GB | 0015072 | * | 11/1884 | 44/530 |
| GB | 0010371 | * | 9/1887 | 44/530 |
| GB | 0004770 | * | 2/1909 | 44/530 |
| GB | 216153 | | 5/1924 | |
| GB | 0402838 | * | 11/1933 | 44/552 |
| GB | 0609068 | * | 9/1948 | 44/522 |
| GB | 839602 | | 6/1960 | |
| GB | 2150594 | * | 11/1984 | 44/522 |

* cited by examiner

*Primary Examiner*—Margaret Medley
(74) *Attorney, Agent, or Firm*—Andrus, Sceales, Starke & Sawall, LLP

(57) ABSTRACT

A fire starter consists of a ring-shaped mass of combustible of wax and wood. It consists of a series of inverted frusto-conical sections connected together by a series of inverted triangular connecting sections and a having a substantially central aperture, and having spacers for supporting the mass of material above a supporting surface, e.g. the floor of a fireplace. During the process for manufacturing the fire starter, the wax and wood mixture is subject to high pressure of 700 psi to 800 psi resulting in the formation of veneer layer of wax on the outer surfaces of the fire starter. During combustion of the fire starter, a venturi effect is created by a flow of air to the aperture, providing a relatively high, intense flame. The fire starter burns for a period of time, e.g, 8–12 minutes, and the intensity of the flame generated is capable of igniting conventional fireplace logs without the use of kindling. Multiple fire starters are packaged by placing the fire starters in vertical stacked relationship within the internal cavity of a tubular package. A rolled sheet of instructions is inserted through the aligned apertures in the stacked fire starters.

3 Claims, 3 Drawing Sheets

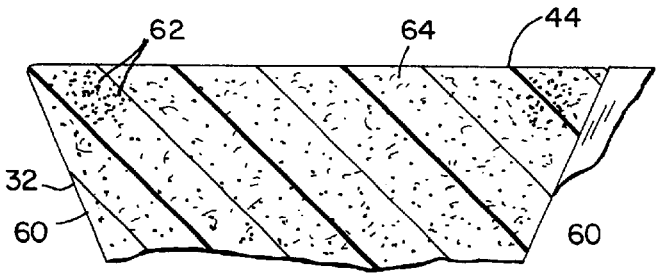
FIG. 5
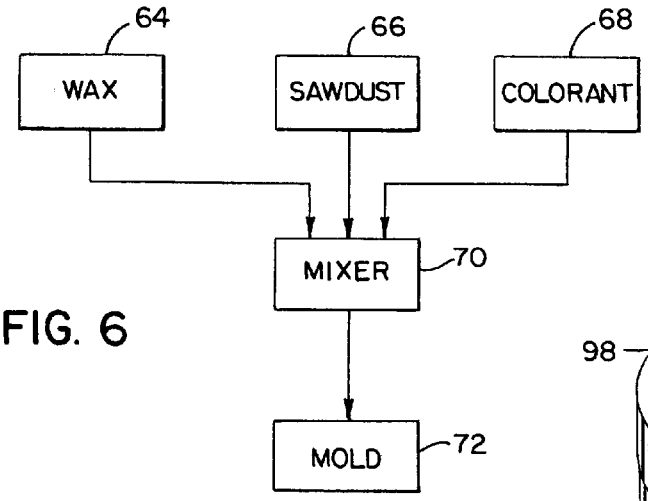
FIG. 6
FIG. 8
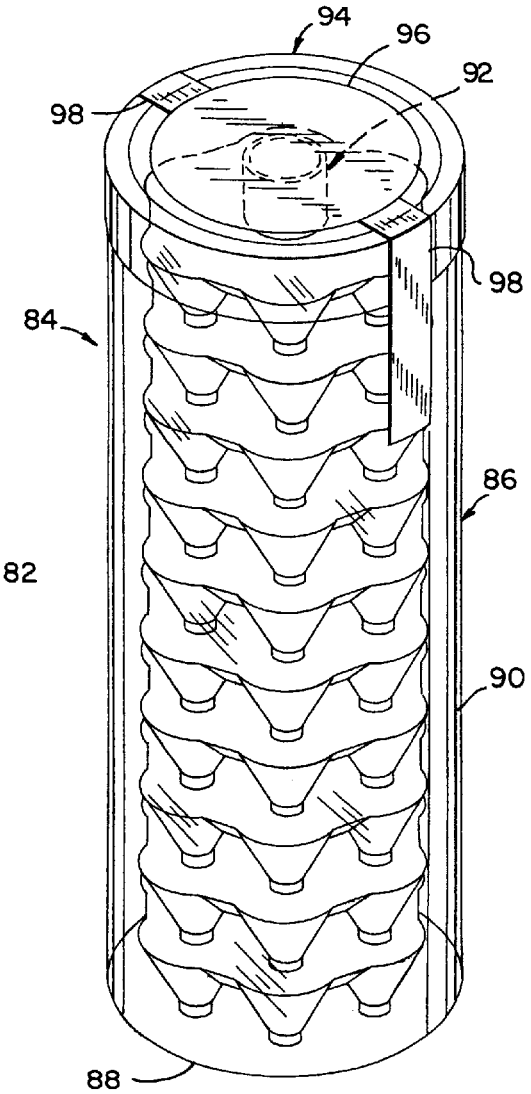
FIG. 7
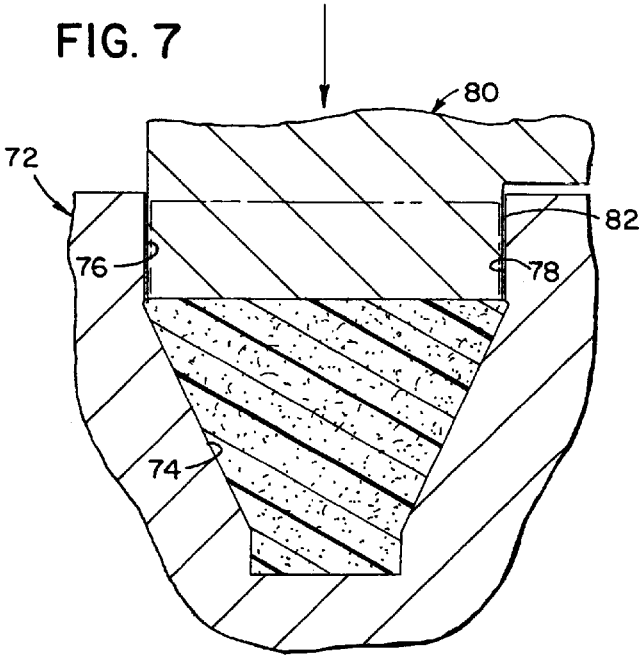

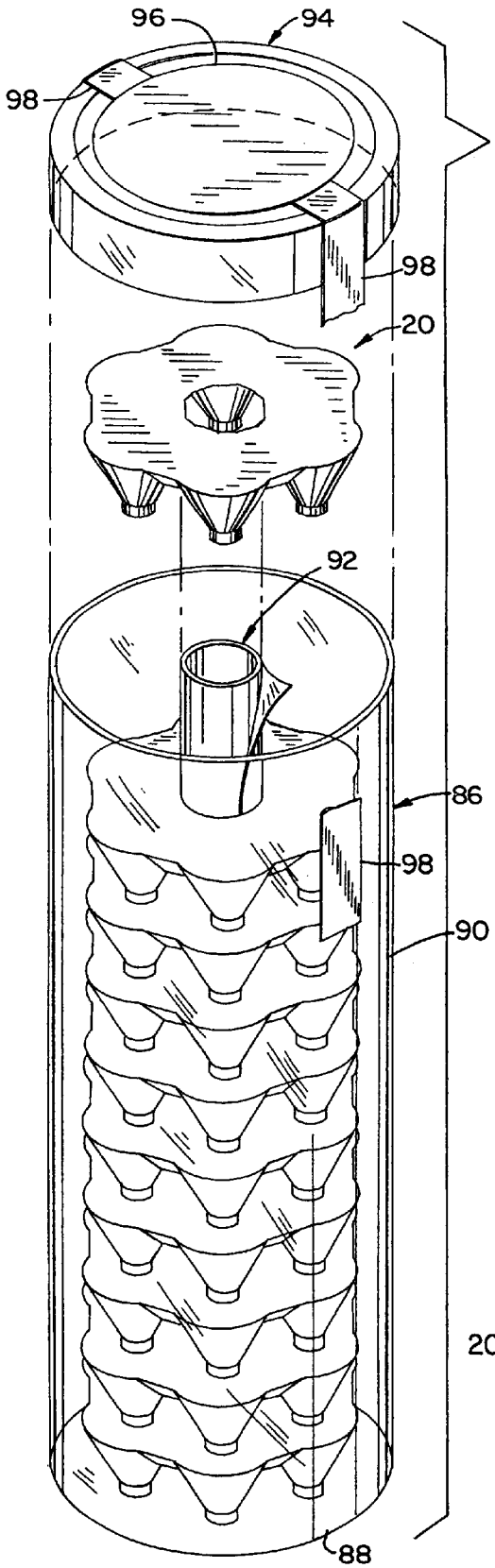
FIG. 9
FIG. 10
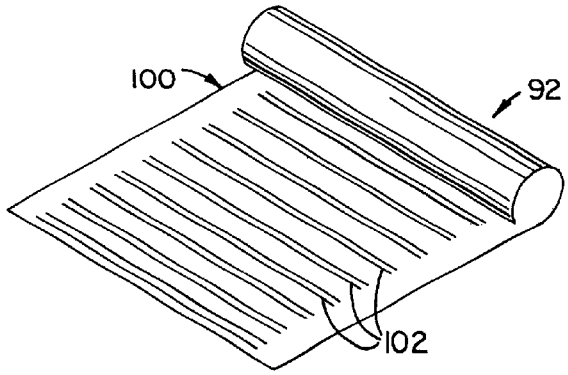
FIG. 11
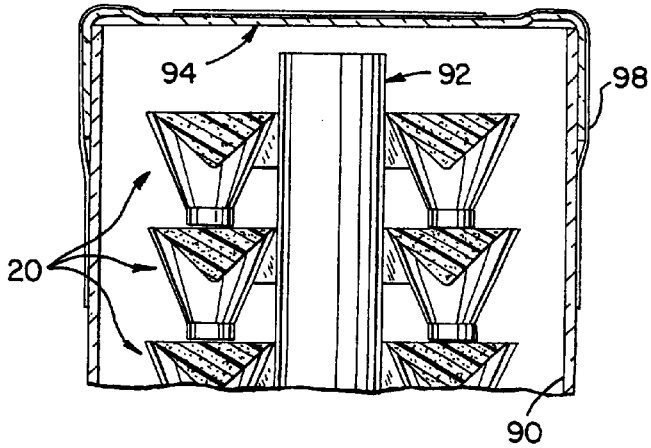

FIRE STARTER AND METHOD OF MAKING SAME

This application is a continuation of Ser. No. 08/023,587 filed Feb. 26, 1993, now abandoned.

BACKGROUND AND SUMMARY

This invention relates to a fire starter construction, a method of making a fire starter, and a package construction for use in packaging of fire starters.

Fire starters in the form of a block of wax and wood particles are known. This type of fire starter is generally rectangular in cross-section, and is provided in blocks of predetermined lengths. The block is placed below a quantity of material to be burned, such as charcoal or wood, and is ignited using a match or other flame source. The wax and wood particles burn to ignite the charcoal or wood. While this type of fire starter generally functions to ignite such material, it is disadvantageous in that a relatively large quantity of fire starter material must be used to generate a sufficiently intense flame for a long enough period of time to ignite the material to be burned. Further, fire starters of this type are cumbersome to package and sell at the retail level.

It is also known in the prior art to provide a metal platform onto which wood chips are placed. The chips are either coated with wax or impregnated with a combustible fuel. The platform is provided with openings, and is placed onto a supporting surface, such as the floor of a fireplace. The chips are then ignited, and burning of the chips ignites the fireplace logs. Again, this generally functions to ignite a fire, but is disadvantageous in its requirement of a separate metal platform which must be recovered from the ashes before subsequent reuse in igniting a new fire. In addition, the intensity of the flame generated by burning of the chips is often insufficient to ignite fireplace logs.

It is an object of the present invention to provide a fire starter which is extremely simple in its construction and operation, yet which provides highly satisfactory performance in igniting combustible material such as charcoal or logs. Another object of the invention is to provide a method of making a fire starter which is likewise relatively simple, yet which results in a fire starter providing a high level of performance. A further object of the invention is to provide a fire starter packaging arrangement which efficiently and economically packages fire starters for sale.

In accordance with one aspect of the invention, a fire starter construction provides a mass of solid combustible material having an aperture therethrough. The fire starter includes support structure which supports the mass of material above a supporting surface, such as the floor of a fireplace or the lower grate of a grill. The support structure includes one or more air spaces located below the mass of material, for providing flow of air to the aperture during combustion of the mass of material. The mass of material consists of a mixture of wax and wood particles, and is formed to a closed shape. The aperture extends substantially through the center of the closed shape defined by the mass of material. The mass of material is formed to provide an outer veneer layer, consisting primarily of wax, which defines the outer surfaces of the mass of material. The wood particles are distributed throughout an inner portion of the mass of material, located inwardly of the outer veneer layer. The mass of material is formed by placing a quantity of wax and wood particles into a mold while in a flowable state, and subjecting the quantity of wax and wood particles to pressure exceeding approximately 250 psi, preferably 700 psi to 800 psi. The mass of material is then solidified. The mass of material is preferably in the form of a ring-shaped member, and the support means is in the form of two or more spacer elements formed integrally with the ring-shaped member and extending downwardly therefrom for supporting the ring-shaped member above the supporting surface. The spacer elements are spaced from each other to define passages therebetween, for providing flow of air to the aperture during combustion of the ring-shaped member. Each spacer element defines a substantially flat lower surface for placement on the supporting surface, and an inverted conical wall extending upwardly from the flat lower surface. The spacer elements are interconnected together by connecting portions of the solid combustible material, and the connecting portions are preferably provided with an inverted triangular cross-section. The spacer elements and the connecting portions cooperate to define a substantially planar upper surface on the ring-shaped mass of material.

The invention further contemplates a method of making a fire starter. The method involves providing a mixture of wax and wood particles in a flowable state, and forming the mixture to a shape providing an upper mass of material having an aperture therethrough, and one or more spaced downwardly extending support portions. The mass of material is preferably formed to a shape as summarized above. Thereafter, the mass of material is solidified. The step of forming the mixture of wax and wood particles is carried out by placing the mixture into a mold having a cavity with a shape corresponding to the final desired shape of the mass of material, and subjecting the mixture to pressure within the mold cavity in excess of approximately 200 psi. Preferably, the mixture is subjected to pressure in the range of 700 psi to 800 psi, which functions to cause the wood particles in the mixture to migrate inwardly from the mold surfaces to form the outer veneer layer consisting primarily of wax, as summarized previously.

The invention further contemplates a package for a plurality of fire starters constructed as summarized above. The package includes a substantially tubular container having a bottom wall and one or more upstanding side walls defining an internal cavity. A plurality of fire starters are placed within the internal cavity in vertical stacked relationship such that the apertures in the fire starters are aligned with each other. A retainer is placed through the aligned apertures in the fire starters to retain the fire starters in alignment with each other within the container cavity. The container defines an open end opposite the bottom wall, and a cap member is engageable with the container at its open end to enclose the container cavity after placement of the fire starters and the retainer therein. In a particularly preferred arrangement, the retainer consists of a rolled sheet of printed instructions. The upstanding wall of the container is preferably formed of a transparent material, so as to allow visual access to the fire starters within the internal cavity of the container.

Various other features, objects and advantages will be made apparent from the following description taken together with the drawings.

BRIEF DESCRIPTION OF THE DRAWINGS

The drawings illustrate the best mode presently contemplated of carrying out the invention.

In the drawings:

FIG. 5 is an enlarged partial cross-sectional view showing a portion of the fire starter of FIGS. 1–4;

FIG. 6 is a schematic diagram illustrating the method steps involved in making the fire starter of FIGS. 1–5;

FIG. 7 is a partial cross-sectional view through a mold arrangement for producing the fire starter of FIGS. 1–5;

FIG. 8 is an isometric view showing a packaging arrangement for packaging a number of fire starters constructed according to the invention;

FIG. 9 is an exploded isometric view showing the manner in which fire starters constructed according to the invention are assembled into the packaging arrangement of FIG. 8;

FIG. 10 is an isometric view showing the instruction sheet comprising a part of the packaging arrangement of FIGS. 8 and 9; and FIG. 11 is a partial sectional view showing the upper portion of the packaging arrangement of FIG. 8.

DETAILED DESCRIPTION OF THE INVENTION

Figure 1:
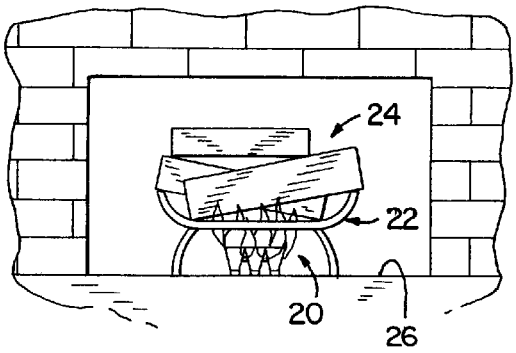
FIG. 1 is a front elevation view showing a fire starter constructed according to the invention in use for igniting logs in a fireplace.

Referring to FIG. 1, a fire starter 20 constructed according to the invention is shown positioned below a fireplace grate 22 for igniting several logs, shown generally at 24, supported by grate 22. Fire starter 20 and grate 22 are positioned on a horizontal floor 26 of the fireplace.

Figure 2:
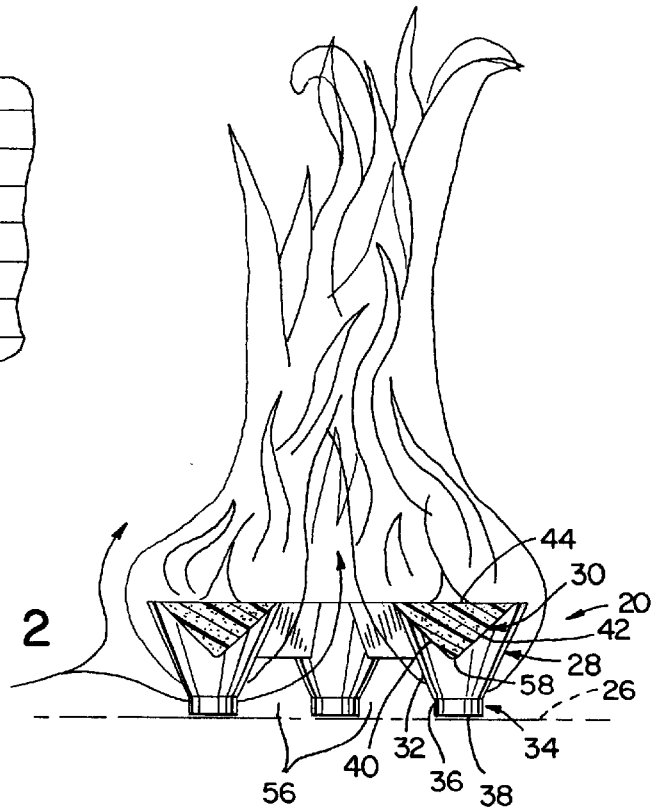
FIG. 2 is a section view of the fire starter of FIG. 1.
Figure 3:
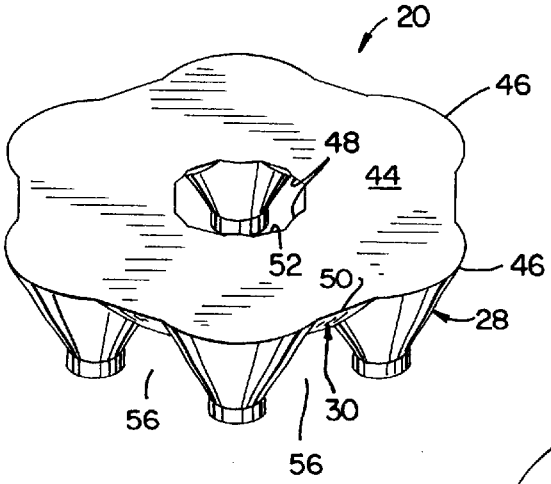
FIG. 3 is an isometric view of the fire starter of FIGS. 1 and 2.
Figure 4:
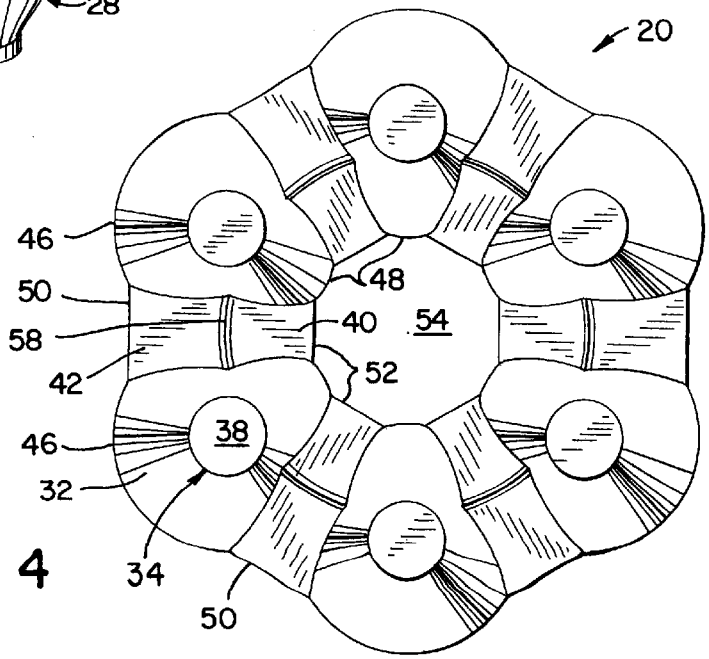
FIG. 4 is a bottom plan view of the fire starter of FIGS. 1–3.

The construction of fire starter 20 is illustrated in detail in FIGS. 2–4. Generally, fire starter 20 consists of a series of spaced inverted frusto-conical sections 28 connected together by a series of inverted triangular connecting sections 30. Each frusto-conical section 28 consists of a flared upwardly divergent side wall 32. A round foot 34, defining a side wall 36 and a bottom surface 38, extends downwardly from the lower end of each frusto-conical section 28.

Each connecting section 30 includes an inner wall 40 and an outer wall 42. Walls 40, 42 are at right angles to each other.

Frusto-conical sections 28 and connecting sections 30 define a coplanar common upper horizontal surface 44.

Referring to FIGS. 3 and 4, side wall 36 of each inverted frusto-conical section 28 defines an arcuate upper outer edge 46 and an arcuate upper inner edge 48. Each connecting section 30 defines linear upper outer and inner edges 50, 52. Linear outer edges 50 extend between adjacent arcuate outer edges 46. Likewise, linear inner edges 52 extend between adjacent arcuate inner edges 48.

As illustrated in FIG. 4, arcuate inner edges 48 and linear inner edges 52 define the boundaries of an aperture 54. Aperture 54 extends substantially centrally through fire starter 20.

As shown in FIGS. 3 and 4, fire starter 20 provides a substantially ring-shaped mass of material spaced above floor 26 when lower surfaces 38 of feet 34 are engaged with floor 26.

A space 56 is provided between adjacent frusto-conical sections 28. Spaces 56 are bounded by frusto-conical member side walls 32, feet side walls 36 and an edge, shown at 58, defined at the intersection of connecting section walls 40, 42. When feet lower surfaces 38 are engaged with floor 26 to support fire starter 20 thereabove, spaces 56 provide flow of air to the interior of the ring-shape defined by fire starter 20 and to aperture 54.

As shown in FIG. 4, the ring-shaped member defined by frusto-conical sections 28 and connecting sections 30 includes six equally spaced frusto-conical sections 28 and six equally spaced connecting sections 30. Frusto-conical sections 28 are arranged such that the center-to-center spacing between adjacent frusto-conical sections 28 is approximately 1 inch. Feet 38 have a diameter of approximately 5/16 inch, which likewise is the diameter of the truncated lower end of each frusto-conical section 28. Each frusto-conical section side wall 32 flares upwardly from its lower end at an angle of approximately 25° from vertical. The width of each connecting section 30, between edges 50 and 52, is approximately 1 inch. The lower edge 58 defined by each connecting section 30 is spaced below upper surface 44 approximately 7/16 inch. The overall height of fire starter 20 is approximately 3/4 inch. Overall, the greatest transverse dimension defined by diametrically opposed frusto-conical sections 28 is approximately 2 7/8 inches. Aperture 54, which is roughly circular in shape, has a diameter of approximately 5/8 inch 11/16 inch. These dimensions are representative of a prototype construction of fire starter 20, and it is understood there may be variations therein without departing from the basic configuration and construction of fire starter 20 as illustrated and described.

Fire starter 20 is formed of a material consisting generally of wax and combustible particles, such as wood particles. Specifically, fire starter 20 is constructed of a material consisting of a premium candle wax base mixed with conventional fine dried white pine sawdust. Referring to FIG. 5, fire starter 20 provides an outer veneer layer 60 consisting primarily of solidified wax. The material of fire starter 20 inwardly of veneer 60 consists of wood particles 62 distributed relatively evenly throughout the wax base, shown at 64.

The function of veneer layer 60, and the manner in which veneer layer 60 is formed, will later be explained.

FIGS. 6 and 7 illustrate the manner in which fire starter 20 is manufactured. As shown in FIG. 6, the basic ingredients employed in manufacture of fire starter 20 are a quantity of wax 64, a quantity of sawdust 66 and a small amount of colorant 68. As noted previously, wax 64 is premium grade candle wax, which is heated to a temperature of 165° F. to 170° F. to melt wax 64 such that wax 64 is in a liquid state. Wax 64 is then placed into a mixer, shown schematically at 70. Alternatively, of course, wax 64 may be melted to a liquid state in mixer 70. Sawdust 66 is then added to mixer 70. The liquid wax 64 penetrates and impregnates the individual wood particles of sawdust 66 during mixing of wax 64 and sawdust 66 within mixer 70. Thereafter, colorant 68 is added to mixer 70, to impart coloration to the wax and sawdust mixture. Representatively, a small quantity of a fluorescent blaze orange colorant is employed to impart an aesthetically pleasing and eye-catching color to the wax and sawdust mixture.

Representatively, wax 64 and sawdust 66 are provided in a ratio of approximately 1:1, i.e. one part by volume of wax 64 and one part by volume of sawdust 66. Any quantity of colorant 64 desired can be added to impart a desired coloration to the wax and sawdust mixture, without effecting the performance of fire starter 20.

After wax 64, sawdust 66 and colorant 68 is completely mixed within mixer 70 to a homogeneous state, the wax/sawdust/colorant mixture is placed into a mold 20 72.

A cross-section through mold 72 is shown in FIG. 7. Mold 72 includes a ring-shaped mold cavity 74 having mold surfaces which correspond in shape to the shape of fire starter 20 as illustrated in FIGS. 2–4 and as described above. Mold 72 further includes a ring-shaped upwardly facing entrance defined by outer and inner walls 76, 78, respectively, leading into cavity 74. A ram 80, having a depending ring-shaped member 82, is employed in combination with mold 72.

A quantity of wax/sawdust/colorant material is placed into mold cavity 74 through the entrance thereto defined by walls 76, 78. Thereafter, ram 80 is moved downwardly toward mold 72 such that ring-shaped member 82 of ram 80 extends into the entrance to mold cavity 74 defined by walls 76, 78. As shown in FIG. 7, the walls of ring-shaped member 82 are in close proximity to entrance walls 76, 78. Once ram 80 is placed into its FIG. 7 position, downward force is exerted on ram 80 so as to apply pressure to the wax/sawdust/colorant mixture contained within mold cavity 74 of 700 psi to 800 psi. It as been found that applying such pressure to the wax/sawdust/colorant mixture creates veneer layer 60 on the outer surfaces of fire starter 20. During exertion of pressures in the vicinity of 700 psi to 800 psi on the wax/sawdust/colorant material, it has been found that the wood particles, such as shown at 62 in FIG. 5, migrate inwardly within the semi-liquid mixture away from the surfaces of mold cavity 74, to thereby produce veneer layer 60, such that veneer layer 60 forms a wax skin on the outer surfaces of fire starter 20.

Mold 72 is cooled in a conventional manner such as by water jacketing. After the 700 psi to 800 psi pressure has been applied for a period of approximately 10 to 15 seconds, ram 80 is moved vertically upwardly away from mold 72. The cooling of mold 72 hardens the wax/sawdust/colorant mixture into a solid mass of material, which is then removed from mold cavity 74 in a conventional manner. Mold 72 preferably includes multiple cavities similar to cavity 74 for mass-production of fire starters 20.

In operation, fire starter 20 as shown in FIGS. 1–5 and constructed according to the method of FIGS. 6 and 7, functions as follows. A user first loads logs 24 into fireplace grate 22, and then places fire starter 20 on fireplace floor 26 such that lower surfaces 38 of feet 34 rest on fireplace floor 26. The user then lights a match, and drops the match through aperture 54. The lighted match ignites veneer layer 60 in a location adjacent the flame, to initially ignite fire starter 20. The flame then migrates throughout veneer layer 60 defining the outer surfaces of fire starter 20 to ignite veneer layer 60 throughout substantially the entire surface area of fire starter 20. After initial ignition of fire starter 20 in this manner, the flame migrates inwardly to ignite wood particles 62, which are impregnated with the wax material. The material of fire starter 20 is relatively dense due to the high pressures exerted thereon during manufacture. The relative density of the material allows fire starter 20 to burn for a significant period of time, such as ten to twelve minutes.

During combustion of fire starter 20, passages 56 between adjacent frusto-conical sections 28 function to supply air to aperture 54. Passages 56 and aperture 54 are sized such that flow of air in this manner provides a venturi effect through passages 56 and upwardly through aperture 54, to accelerate the air during combustion of fire starter 20. This venturi effect results in a relatively high central flame emanating from aperture 54. In addition, the outer surfaces of fire starter 20 ignite to provide an outer circumferential flame. When the central and outer flames contact the undersides of logs 24, the flames spread out below logs 24. Since fire starter 20 maintains these flames for a substantial period of time, logs 24 can normally be ignited using a single fire starter 20 without the use of kindling.

It can thus be appreciated that fire, starter 20 provides a simple, efficient and effective means of starting a fire.

While fire starter 20 has been shown and described in connection with lighting of logs in a fireplace, it is understood that fire starter 20 can be used in any other application where it is desired to ignite combustible material, e.g. igniting campfire branches and logs, igniting charcoal in a grill, or the like.

FIGS. 8–11 illustrate a preferred packaging arrangement for a number of fire starters 20. Referring to FIG. 8, a package assembly 84 consists of a cylindrical tube 86 having a bottom wall 88 and a side wall 90, which cooperate to define an internal cavity. A number of fire starters 20, e.g. ten, are placed into the internal cavity defined by tube 86 in vertical stacked relationship. When placed within tube 86, the lower surfaces 38 of the feet 34 of each fire starter 20 engage the upper surface 44 of the fire starter 20 therebelow. Fire starters 20 are placed into tube 86 such that apertures 54 are substantially aligned with each other. A tubular retainer, shown generally at 92, is then inserted through the aligned apertures 54 of fire starters 20. A cap 94 is then engaged with tube side wall 90 at the open upper end of tube 86, to enclose the internal cavity defined thereby and to retain fire starters 20 and retainer 92 therein. An adhesive label, consisting of a circular inner portion 96 and a pair of tabs 98, is then placed onto the upper surface of cap 94 such that tabs 98 extend downwardly along the side wall of cap 94 and into engagement with tube side wall 90. In this manner, cap 94 is retained on tube 86. After label tabs 98 have been broken to open package assembly 84, cap 94 can be repeatedly engaged and disengaged with the upper end of tube side wall 90 to repeatedly open and close package assembly 84.

Referring to FIG. 10, retainer 92 consists of a rolled sheet 100. Sheet 100 contains printing 102, which is the instructions for use of fire starters 20.

As noted previously, rolled sheet 100 extends through fire starter apertures 54, as shown in FIG. 11, to retain fire starters 20 in vertical alignment with each other within the internal cavity defined by tube 86. With this arrangement, fire starters 20 are held in position relative to each other, which functions to prevent fire starter edges 46 from engaging tube side wall 90 during shipping and handling, which otherwise may result in chipping of edges 46. In addition, since retainer 92 consists of rolled sheet 100, the uncoiling force exerted on inner edges 48, 52 by retainer 92 functions to engage each fire starter 20 with retainer 92. This frictional engagement of fire starters 20 with retainer 92 also prevents fire starters 92 from moving vertically relative to each other when contained within tube 86.

Use of rolled sheet 100 containing printed instructions 102 eliminates the need for any instructional material to be placed onto tube 86 or cap 94. Tube 86 and cap 94 are preferably constructed of a transparent material such as clear plastic, to provide visual access to fire starters 20 when packaged therewithin. With instructions 102 provided on rolled sheet 100, the package provided by tube 86 and cap 94 is uncluttered and unobstructed, providing free visual access throughout nearly the entirety of tube 86 to fire starters 20 therewithin.

Various alternatives and embodiments are contemplated as being within the scope of the following claims particularly pointing out and distinctly claiming the subject matter regarded as the invention.

We claim:

1. A fire starter, consisting of a mass of solid combustible material of a mixture of wax and wood particles and having a closed shape and a coplanar, common, upper horizontal surface, consisting of a series of spaced, inverted, frustro-conical sections connected together by a series of inverted triangular connecting sections, each frustro-conical section consisting of a flared outwardly diverging sidewall, at least two spaced apart feet, each having a sidewall and a bottom surface extending downwardly from the lower end of each frustro-conical section for engagement with a supporting surface, the frustro-conical sections and the connecting sections defining the upper surface, the sidewall of each inverted frustro-conical section defining an arcuate upper outer edge and an arcuate upper inner edge, each connecting section defining linear upper outer and inner edges, the linear outer edges extending between adjacent arcuate outer edges, and the linear inner edges extending between adjacent arcuate inner edges, the arcuate inner edges and the linear inner edges defining boundaries of an aperture extending substantially centrally through the upper surface, the frustro-conical sections forming laterally, outwardly opening air spaces providing flow of air to the aperture during combustion of the mass of solid combustible material, each air passage being inwardly convergent so as to accelerate air as it passes from the exterior of the fire starter into the aperture, wherein the mass of solid combustible material defines an outer veneer layer defining at least in part the outer surface of the mass of solid combustible material, the veneer layer consisting primarily of wax, and wherein the wood particles are distributed throughout an inner portion of the mass of solid combustible material located inwardly of the veneer layer.

2. The fire starer of claim 1, wherein the veneer layer and the inner portion of the mass of solid combustible material are formed by placing a quantity of wax and wood particles into a mold while in a flowable state, subjecting the quantity of wax and wood particles to pressure exceeding approximately 700 psi, and solidifying the quantity of wax and wood particles.

3. The fire starter of claim 1, wherein the mass of solid combustible material comprises a ring-shaped member.

* * * * *